US009436191B2

(12) United States Patent
Thakur

(10) Patent No.: US 9,436,191 B2
(45) Date of Patent: Sep. 6, 2016

(54) VOLTAGE REGULATION SYSTEM FOR INTEGRATED CIRCUIT

(71) Applicant: Nishant Singh Thakur, Indore (IN)

(72) Inventor: Nishant Singh Thakur, Indore (IN)

(73) Assignee: FREESCALE SEMICONDUCTOR, INC., Austin, TX (US)

( * ) Notice: Subject to any disclaimer, the term of this patent is extended or adjusted under 35 U.S.C. 154(b) by 227 days.

(21) Appl. No.: 14/488,261

(22) Filed: Sep. 16, 2014

(65) Prior Publication Data

US 2016/0077533 A1 Mar. 17, 2016

(51) Int. Cl.
*G05F 1/10* (2006.01)

(52) U.S. Cl.
CPC ..... *G05F 1/10* (2013.01)

(58) Field of Classification Search
CPC ..... G05F 3/262; G05F 3/265; G05F 3/30; G05F 3/205; G05F 1/10; G05F 1/468
USPC ..... 327/530, 538
See application file for complete search history.

(56) References Cited

U.S. PATENT DOCUMENTS 5,977,757 A * 11/1999 Felps ..... G05F 1/613 323/282
6,580,256 B1 * 6/2003 Martindale ..... H02M 3/156 323/280
7,085,943 B2 8/2006 Chun et al.
7,397,228 B2 7/2008 Barrows
7,518,355 B2 4/2009 Grassi et al.
7,679,344 B2 3/2010 Carlson et al.
8,080,897 B1 12/2011 Virutchapunt
8,161,431 B2 4/2012 Buonpane et al.
8,689,023 B2 4/2014 Gupta et al.
8,928,397 B2 * 1/2015 Kodera ..... H01L 27/0802 327/308
2005/0024035 A1 2/2005 Tabaian
2007/0271473 A1 11/2007 Hosomi
2013/0093505 A1 * 4/2013 Gupta ..... G05F 1/575 327/540
2013/0221937 A1 8/2013 Yan

* cited by examiner

*Primary Examiner* — Timothy J Dole
*Assistant Examiner* — Shahzeb K Ahmad
(74) *Attorney, Agent, or Firm* — Charles E. Bergere

(57) ABSTRACT

An integrated circuit (IC) includes a power grid having first, second, third, and fourth nodes for receiving first supply, first ground, second supply, and second ground voltage signals, respectively. A feedback circuit is connected to the second and fourth nodes for receiving the second supply and second ground voltage signals and generating a feedback voltage signal based on a difference between the second supply and second ground voltage signals. A resistor-ladder network receives the feedback signal and generates a sense voltage signal. A voltage regulator compares the sense voltage signal with a reference voltage signal and regulates the first supply voltage signal at a first voltage level.

7 Claims, 4 Drawing Sheets

-PRIOR ART-

VOLTAGE REGULATION SYSTEM FOR INTEGRATED CIRCUIT

BACKGROUND OF THE INVENTION

The present invention relates generally to integrated circuits, and, more particularly, to a voltage regulation system for an integrated circuit (IC).

Integrated circuits (ICs) include various circuit components, such as resistors, transistors, and inductors on a single chip. These circuit components are used to form logic circuits. Power is distributed to the logic circuits using a network of conductors. There are two types of such networks: power grids and ground grids. With the advent of micron-sized ICs, the size of the power and ground grids and the IR drop of the ICs have increased. Typically, the logic circuits are powered by a supply voltage signal. The supply voltage signal is transmitted to the logic circuits using the power grid. The ground grid supplies a ground voltage signal to the logic circuits. Each logic circuit is connected between nodes of the power and ground grids. The logic circuits receive the supply voltage signal at a first node of the power grid (hereinafter referred to as a 'supply cold point'). There is a minimum IR drop in a first voltage level of the supply voltage signal at the supply cold point. The circuit components between the nodes of the power grid cause IR drops in the first voltage level of the supply voltage signal. As a result, the supply voltage signal received at a second node of the power grid (hereinafter referred to as a 'supply hot point') has a second voltage level that is less than the first voltage level by a voltage level equal to the IR drop at the supply hot point.

Similarly, the logic circuits receive a ground voltage signal first at a first node of the ground grid (hereinafter referred to as a 'ground cold point'). There is minimum IR drop in a first voltage level of the ground voltage signal received at the ground cold point. The circuit components of the ground grid introduce IR drops in the ground voltage signal that cause a rise in the first voltage level of the ground voltage signal. As a result, the ground voltage signal received at a second node of the ground grid (hereinafter referred to as a 'ground hot point') has a second voltage level that is greater than the first voltage level by a voltage level equal to the IR drop at the ground hot point.

Typically, the first and second voltage levels of the supply voltage signal supplied to the IC are required to be within a predetermined range. If the first voltage level of the supply voltage signal at the supply cold point exceeds the highest predetermined voltage level of this range, then the IC may be damaged. Similarly, if the second voltage level of the supply voltage signal at the supply hot point is less than the lowest predetermined voltage level of the range, then the timing of critical paths of the IC can be affected, which may increase the functional timing of the IC. A difference between the highest and lowest voltage levels of the supply voltage signal is shrinking with the decreasing size of ICs.

Voltage monitor and regulator circuits are used to monitor and regulate the first and second voltage levels of the supply voltage signal. A voltage regulator provides the supply voltage signal to the supply cold point and regulates the first and second voltage levels of the supply voltage signal within the predetermined voltage range. FIG. 1 shows an IC 100 that includes a power grid having a plurality of supply and ground voltage lines, first and second logic circuit modules 102 and 104, first and second sets of circuit components 106 and 108, a resistor-ladder network 110, and a voltage regulator 111. The voltage regulator 111 includes an amplifier

112, a bipolar junction transistor (BJT) 114, a first resistor 116, and a capacitor 118. The resistor-ladder network 110 includes second and third resistors 120 and 122.

A first supply voltage line includes first and second nodes (N1 and N2). The first set of circuit components 106 is connected between the first and second nodes (N1 and N2). The first node (N1) receives a first supply voltage signal with no IR drop and the second node (N2) receives a second supply voltage signal that has a voltage level equal to a difference between the voltage level of the first supply voltage signal and a voltage drop across the first set of circuit components 106. A first ground voltage line GND1) includes third and fourth nodes (N3 and N4). The second set of circuit components 108 is connected between the third and fourth nodes (N3 and N4). The third node (N3) receives a first ground voltage signal (GND1) with no IR drop and the fourth node receives a second ground voltage signal (GND2) that has a voltage level equal to a sum of the voltage level of the first ground voltage signal and a voltage rise across the second set of circuit components 108.

The first logic circuit module 102 is connected between the first and third nodes (N1 and N3), and the second logic circuit module 104 is connected between the second and fourth nodes (N2 and N4). A first terminal of the second resistor 120 of the resistor-ladder network 110 is connected to the second node (N2) for receiving the second supply voltage signal. A second terminal of the second resistor 120 is connected to a first terminal of the third resistor 122 to form a voltage tap. A sense voltage signal is generated at the voltage tap. A second terminal of the third resistor 122 is connected to ground. The amplifier 112 has an inverting terminal connected to the voltage tap for receiving the sense voltage signal, a non-inverting terminal for receiving a reference voltage signal (Vref), and an output terminal for outputting an error voltage signal. The BJT 114 has a base terminal connected to the output terminal of the amplifier 112 for receiving the error voltage signal, a collector terminal for receiving an external third supply voltage signal, and an emitter terminal connected to the first node (N1) for providing the first supply voltage signal thereto and to ground by way of the capacitor 116 and the resistor 118.

In operation, the first logic circuit module 102 receives the first supply voltage signal at the first node from the voltage regulator 111 and the first ground voltage signal at the third node. The first ground voltage signal is at zero voltage level. Hence, a voltage across the first logic circuit module 102 equals the voltage level of the first supply voltage signal. The second logic circuit module 104 receives the second supply voltage signal at the second node and the second ground voltage signal at the fourth node. The second ground voltage signal has a non-zero voltage level, and hence a voltage across the second logic circuit module 104 equals a difference between the voltage levels of the second supply and ground voltage signals. As previously mentioned, voltage levels across the first and second logic circuit modules 102 and 104 are required to be within a predetermined voltage range for normal operation of the IC 100. The voltage level across the first logic circuit module 102 and the second logic circuit module 104 should be less than a first predetermined voltage level of the predetermined voltage range and should be more than a second predetermined voltage level of the predetermined voltage range, respectively. The resistor-ladder network 110 receives and scales the second supply voltage signal and outputs the sense voltage signal at the voltage tap. The amplifier 112 receives the sense voltage signal and generates the error voltage signal based on a comparison of the sense voltage signal with the reference voltage signal. The error voltage signal represents an IR drop in the voltage level of the first supply voltage signal. The BJT 114 receives the error voltage signal and regulates the voltage level of the first supply voltage signal such that the voltage levels across the first and second logic circuit modules 102 and 104 are within the predetermined voltage range.

However, the voltage regulator 111 senses only the second voltage level of the supply voltage signal received at the supply hot point, thereby not accounting for the rise in the first voltage level of the ground voltage signal at the ground hot point. When the voltage regulator 111 is an external voltage regulator, the voltage regulator 111 senses the supply voltage signal from the printed circuit board (PCB) and not the IC. The second voltage level of the supply voltage signal of the IC is less than that of the PCB. As a result, the first voltage level of the supply voltage signal is incorrectly regulated and may not be within the predetermined voltage range, which could damage the IC. Moreover, due to regulator-load regulation, the first voltage level of the supply voltage signal changes when a load current of the voltage regulator 111 changes, thereby increasing an output spread of the voltage regulator and decreasing the accuracy of the regulator. As a result, regulation of the first voltage level of the supply voltage signal within the predetermined range becomes difficult. When the voltage regulator 111 is an internal voltage regulator, the amount of heat dissipated increases the inefficiency of the voltage regulator and packaging cost of the IC.

Therefore, it would be advantageous to have an integrated circuit that includes a voltage regulator circuit with very low variation in the output voltage signal.

BRIEF DESCRIPTION OF THE DRAWINGS

The following detailed description of the preferred embodiments of the present invention will be better understood when read in conjunction with the appended drawings. The present invention is illustrated by way of example, and not limited by the accompanying figures, in which like references indicate similar elements.

DETAILED DESCRIPTION OF THE INVENTION

Figure 1:
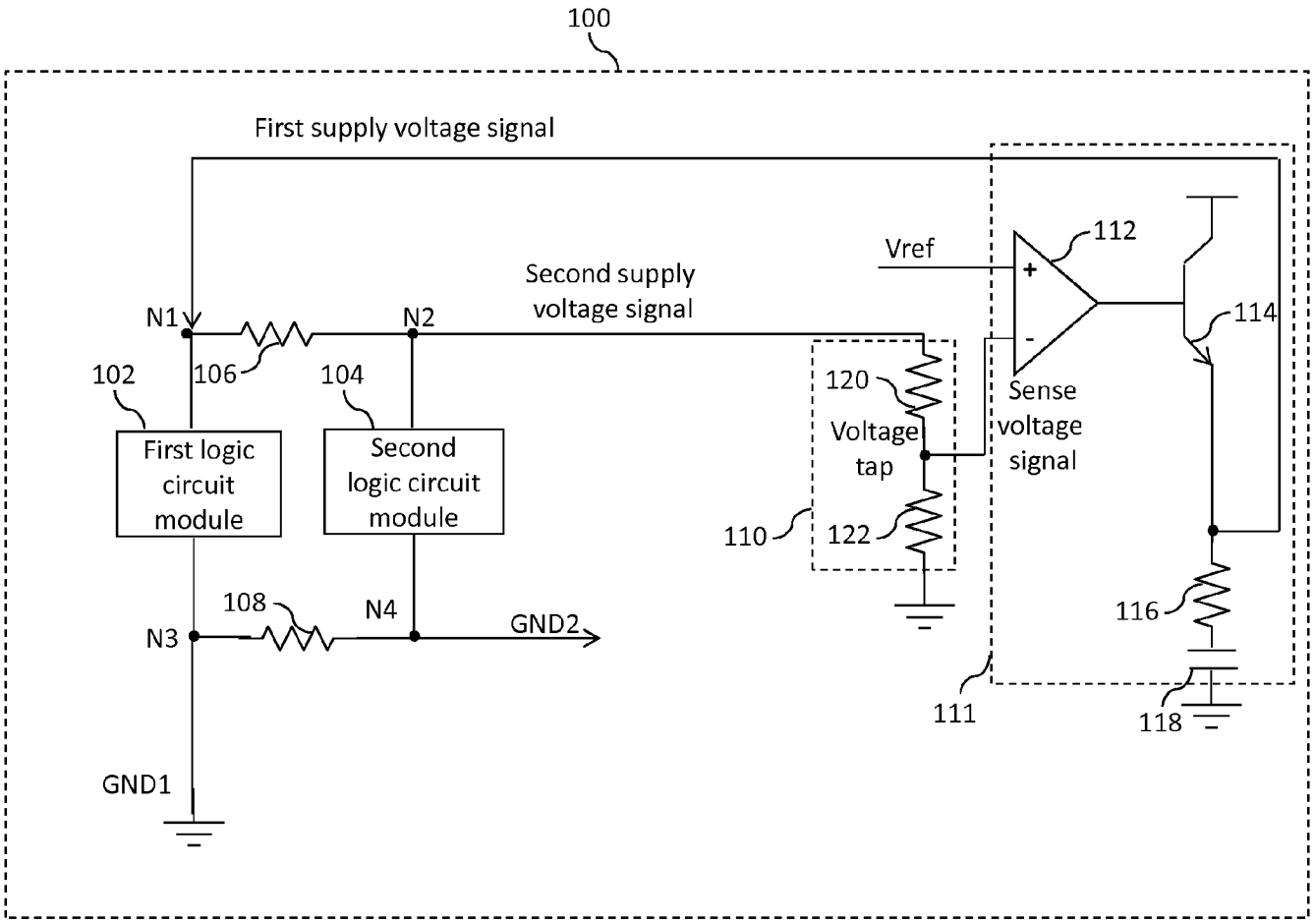
FIG. 1 is schematic block diagram of a conventional integrated circuit (IC) that includes a voltage regulator circuit.

The detailed description of the appended drawings is intended as a description of the currently preferred embodiments of the present invention, and is not intended to represent the only form in which the present invention may be practiced. It is to be understood that the same or equivalent functions may be accomplished by different embodiments that are intended to be encompassed within the spirit and scope of the present invention.

In an embodiment of the present invention, a system for voltage regulation is provided. The system includes a power grid, having a plurality of supply and ground voltage lines, a feedback circuit, a resistor-ladder circuit, and a voltage regulator. A first supply voltage line of the plurality of supply voltage lines includes first and second nodes and a first set of circuit components is connected therebetween. A first ground voltage line of the plurality of ground voltage lines includes third and fourth nodes and a second set of circuit components is connected therebetween. The first and third nodes receive first supply and ground voltage signals, respectively, and the second and fourth nodes receive second supply and ground voltage signals, respectively. The feedback circuit is connected to the fourth node for receiving the second ground voltage signal and generating a feedback voltage signal. The resistor-ladder circuit is connected between the second node and ground and has a voltage tap. The voltage tap is connected to the feedback circuit for receiving the feedback voltage signal. The resistor-ladder circuit generates a sense voltage signal. The voltage regulator that receives an external reference voltage signal is connected to the voltage tap for receiving the sense voltage signal, and the first node for providing the first supply voltage signal thereto. The voltage regulator regulates the first supply voltage signal at a first voltage.

In another embodiment of the present invention, a system for voltage regulation is provided. The system includes a power grid, having a plurality of supply and ground voltage lines, a feedback circuit, a resistor-ladder circuit, and a voltage regulator. A first supply voltage line of the plurality of supply voltage lines includes first and second nodes and a first set of circuit components is connected therebetween. A first ground voltage line of the plurality of ground voltage lines includes third and fourth nodes and a second set of circuit components is connected therebetween. The first and third nodes receive first supply and ground voltage signals, respectively, and the second and fourth nodes receive second supply and ground voltage signals, respectively. The feedback circuit that generates a feedback voltage signal includes a bias-voltage generator and a first amplifier. The bias-voltage generator generates a bias-voltage signal. The first amplifier has an inverting input terminal connected to the fourth node by way of a first resistor for receiving the second ground voltage signal, a non-inverting input terminal connected to the bias-voltage generator for receiving the bias-voltage signal, and an output terminal connected to the inverting input terminal thereof by way of a second resistor for generating the feedback voltage signal. The resistor-ladder circuit is connected between the second node and ground and has a voltage tap that is connected to the output terminal of the first amplifier by way of a third resistor for receiving the feedback voltage signal. The resistor-ladder circuit generates a sense voltage signal. The voltage regulator that receives an external reference voltage signal is connected to the voltage tap for receiving the sense voltage signal, and the first node for providing the first supply voltage signal thereto. The voltage regulator regulates the first supply voltage signal at a first voltage.

In yet another embodiment of the invention, a system for voltage regulation is provided. The system includes a power grid, having a plurality of supply and ground voltage lines, a feedback circuit, a resistor-ladder circuit, and a voltage regulator. A first supply voltage line of the plurality of supply voltage lines includes first and second nodes and a first set of circuit components is connected therebetween. A first ground voltage line of the plurality of ground voltage lines includes third and fourth nodes and a second set of circuit components is connected therebetween. The first and third nodes receive first supply and ground voltage signals, respectively, and the second and fourth nodes receive second supply and ground voltage signals, respectively. The feedback circuit is connected to the second and fourth nodes for receiving the second supply and ground voltage signals, respectively, and generating a feedback voltage signal. The resistor-ladder circuit is connected between the feedback circuit and ground for receiving the feedback voltage signal and having a voltage tap for generating a sense voltage signal. The voltage regulator that receives an external reference voltage signal is connected to the voltage tap for receiving the sense voltage signal, and to the first node for providing the first supply voltage signal thereto. The voltage regulator regulates the first supply voltage signal at a first voltage.

Various embodiments of the present invention provide a system for voltage regulation. The system includes a power grid, having a plurality of supply and ground voltage lines, a feedback circuit, a resistor-ladder circuit, and a voltage regulator. First and second sets of circuit components are connected between first and second nodes (referred to as supply cold and hot points, respectively) of the first supply voltage line and third and fourth nodes (referred to as ground cold and hot points, respectively) of the first ground voltage line, respectively. In an embodiment of the present invention, the feedback circuit is connected to the second and fourth nodes for receiving the second supply and ground voltage signals, respectively. In another embodiment of the present invention, the feedback circuit is connected to the fourth node for receiving the ground voltage signal and generates a feedback voltage signal. The resistor-ladder circuit receives the feedback voltage signal and generates a sense voltage signal at a voltage tap thereof. The voltage regulator receives the sense voltage signal and a third supply voltage signal and provides the first supply voltage signal to the first node at a first voltage level such that voltage levels across first and second logic circuits are within a predetermined voltage range. The voltage regulator senses the second voltage levels of both the supply voltage signal received at the supply hot point and the ground voltage signal received at the ground hot point, thereby accounting for the rise in the first voltage level of the ground voltage signal at the ground hot point. In an embodiment of the present invention, the voltage regulator is an external voltage regulator and as the voltage regulator senses the supply and ground voltage signals from the IC, accurate second voltage levels of the supply and ground voltage signals of the supply and ground hot points are available for regulation. As a result, the first voltage levels of the supply and ground voltage signals are correctly regulated. As the voltage regulator senses the supply and ground voltage signals from the IC, IR drop and rise in the voltage levels of the supply and ground voltage signals decreases. Thus, the voltage regulator reduces the first voltage level of the first supply voltage signal that results in a decrease in power dissipation and consequently reduction in packaging costs.

Figure 2:
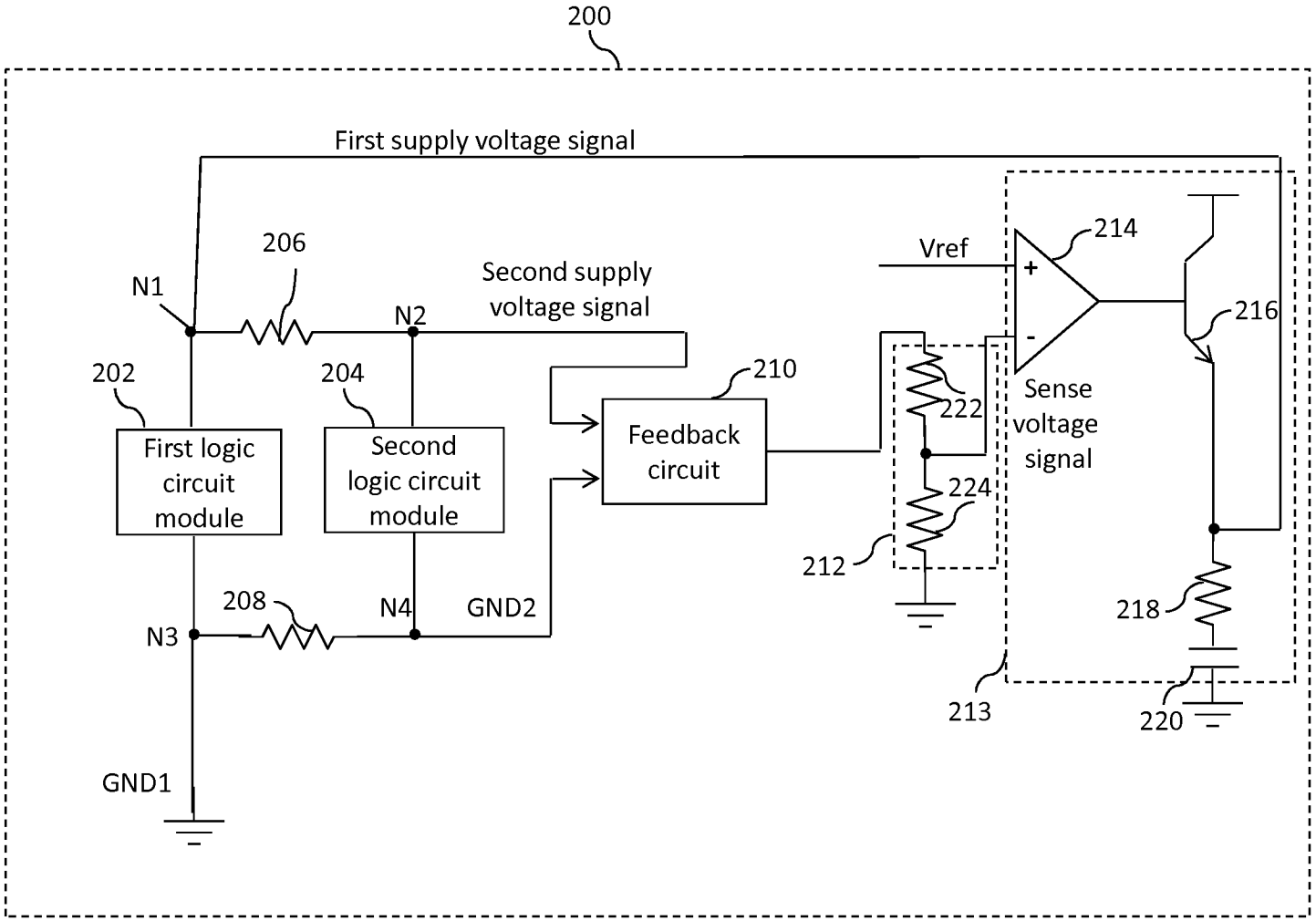
FIG. 2 is a schematic block diagram of an IC that includes a voltage regulator circuit in accordance with an embodiment of the present invention.

Referring now to FIG. 2, a schematic block diagram of an integrated circuit (IC) 200 for voltage regulation in accordance with an embodiment of the present invention is shown. The IC 200 includes a power grid (not shown) having multiple supply and ground voltage lines, first and second logic circuit modules 202 and 204, first and second sets of circuit components 206 and 208, a feedback circuit 210, a resistor-ladder network 212, and a voltage regulator 213. The voltage regulator 213 includes an amplifier 214, a bipolar junction transistor (BJT) 216, a first resistor 218, and a capacitor 220. The resistor-ladder network 212 includes second and third resistors 222 and 224.

A supply voltage line includes first and second nodes (N1 and N2). The first set of circuit components 206 is connected between the first and second nodes. The first node (N1) receives a first supply voltage signal with no IR drop in corresponding voltage level. The second node receives a second supply voltage signal that has a voltage level equal to a difference between the voltage level of the first supply voltage signal and a voltage drop across the first set of circuit components 206. A ground voltage line includes third and fourth nodes (N3 and N4). The second set of circuit components 208 is connected between the third and fourth nodes (N3 and N4). The third node (N3) receives a first ground voltage signal (GND1) with no IR drop in corresponding voltage level. The fourth node (N4) receives a second ground voltage signal (GND2) that has a voltage level equal to a sum of the voltage level of the first ground voltage signal (GND1) and a voltage rise across the second set of circuit components 208. In an embodiment of the present invention, the first and second sets of circuit components 206 and 208 each include at least one of a resistor, a capacitor, and an inductor.

The first logic circuit module 202 is connected between the first and third nodes. The second logic circuit module 204 is connected between the second and fourth nodes. The feedback circuit 210 is connected to the second and fourth nodes for receiving the second supply and ground voltage signals, respectively, and generating a feedback voltage signal. A first terminal of the second resistor 222 of the resistor-ladder network 212 is connected to the feedback circuit 210 for receiving the feedback voltage signal. A second terminal of the second resistor 222 is connected to a first terminal of the third resistor 224 to form a voltage tap. A sense voltage signal is generated at the voltage tap. A second terminal of the third resistor 224 is connected to ground. The amplifier 214 has an inverting terminal connected to the voltage tap for receiving the sense voltage signal, a non-inverting terminal for receiving a reference voltage signal, and an output terminal for outputting an error voltage signal. The BJT 216 has a base terminal connected to the output terminal of the amplifier 214 for receiving the error voltage signal, a collector terminal for receiving an external third supply voltage signal, and an emitter terminal connected to the first node for providing the first supply voltage signal thereto and to ground by way of the resistor 218 and the capacitor 220. In various embodiments of the present invention, the resistor-ladder network 212 may be included in the voltage regulator 213, placed in the IC 200 as an independent circuit, or placed on a printed circuit board (PCB) as an independent circuit.

In an embodiment of the present invention, the first and second sets of circuit components 206 and 208 each include at least one of a resistor, a capacitor, and an inductor.

In operation, the first logic circuit module 202 receives the first supply voltage signal at the first node from the voltage regulator 213 and the first ground voltage signal at the third node. The first ground voltage signal is at zero voltage level. Hence, a voltage across the first logic circuit module 202 equals the voltage level of the first supply voltage signal. The second logic circuit module 204 receives the second supply voltage signal at the second node and the second ground voltage signal at the fourth node. The second ground voltage signal has a non-zero voltage level, and hence a voltage across the second logic circuit module 204 equals a difference between the voltage levels of the second supply and ground voltage signals. Voltage levels across the first and second logic circuit modules 202 and 204 are required to be within a predetermined voltage range for normal operation of the IC 200. The voltage level across the first logic circuit module 202 and second logic circuit module 204 should be less than a first predetermined voltage level of the predetermined voltage range and should be more than a second predetermined voltage level of the predetermined voltage range, respectively. The feedback circuit 210 receives the second supply and ground voltage signals and generates the feedback voltage signal based on a difference between the voltage levels of the second supply and ground voltage signals. The feedback signal indicates to the voltage regulator 213 at least one of an IR drop and IR rise of the first voltage levels of the supply and ground voltage signals. The resistor-ladder network 212 receives the feedback voltage signal and generates the sense voltage signal based on the feedback voltage signal, resistance values of the resistors 222 and 224, and first ground voltage signal. The function of the resistor-ladder network 212 is well known in the art. The amplifier 214 receives the sense voltage signal and generates the error voltage signal based on a comparison of the sense voltage signal with the reference voltage signal. The BJT 114 receives the error voltage signal and regulates the voltage level of the first supply voltage signal such that the voltage levels across the first and second logic circuit modules 202 and 204 are within the predetermined voltage range. The resistor 218 and the capacitor 220 provide stability to the voltage regulator 213.

Figure 3:
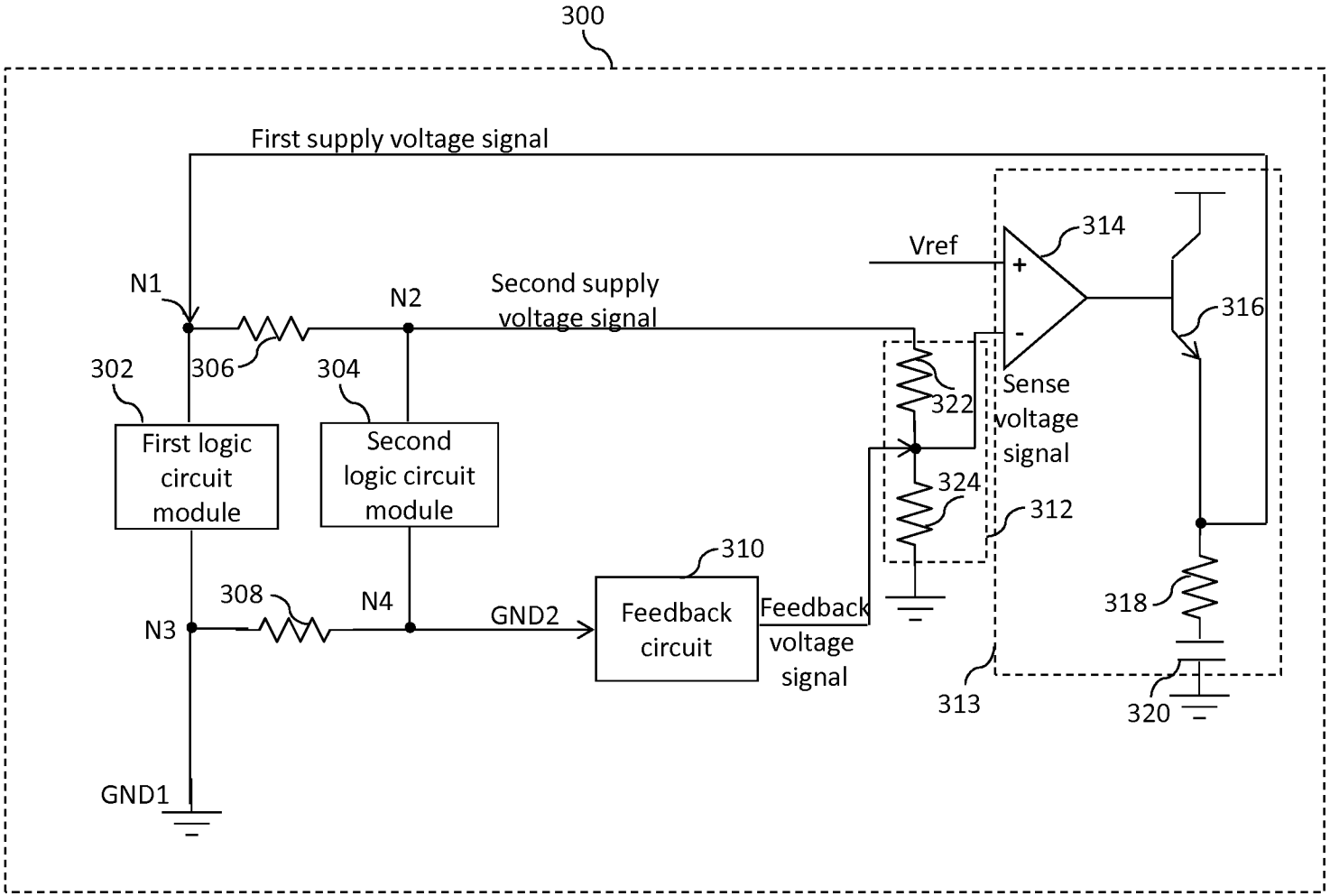
FIG. 3 is a schematic block diagram of an IC that includes a voltage regulator circuit in accordance with another embodiment of the present invention.

Referring now to FIG. 3, a schematic block diagram of an integrated circuit (IC) 200 for voltage regulation, in accordance with another embodiment of the present invention, is shown. The IC 300 includes a power grid (not shown) having multiple supply and ground voltage lines, first and second logic circuit modules 302 and 304, first and second sets of circuit components 306 and 308, a feedback circuit 210, and a resistor-ladder network 312, and a voltage regulator 313. The voltage regulator 313 includes an amplifier 314, a bipolar junction transistor (BJT) 316, a first resistor 318, and a capacitor 320. The resistor-ladder network 312 includes second and third resistors 322 and 324.

A supply voltage line includes first and second nodes. The first set of circuit components 306 is connected between the first and second nodes. The first node receives a first supply voltage signal with no IR drop in a corresponding voltage level. The second node receives a second supply voltage signal that has a voltage level equal to a difference between the voltage level of the first supply voltage signal and a voltage drop across the first set of circuit components 306. A ground voltage line includes third and fourth nodes. The second set of circuit components 308 is connected between the third and fourth nodes. The third node receives a first ground voltage signal with no IR drop in corresponding voltage level. The fourth node receives a second ground voltage signal that has a voltage level equal to a sum of the voltage level of the first ground voltage signal and a voltage rise across the second set of circuit components 308. In an embodiment of the present invention, the first and second sets of circuit components 306 and 308 each include at least one of a resistor, a capacitor, and an inductor.

The first logic circuit module 302 is connected between the first and third nodes. The second logic circuit module 304 is connected between the second and fourth nodes. The feedback circuit 310 is connected to the fourth node for receiving the second ground voltage signal and generating a feedback voltage signal. A first terminal of the second resistor 322 of the resistor-ladder network 312 is connected to the second node for receiving the second supply voltage signal. A second terminal of the second resistor 322 is connected to a first terminal of the third resistor 324 to form a voltage tap that is connected to the feedback circuit 310 for receiving the feedback voltage signal. The resistor-ladder network 312 generates a sense voltage signal at the voltage tap. A second terminal of the third resistor 324 is connected to ground. The amplifier 314 has an inverting terminal connected to the voltage tap for receiving the sense voltage signal, a non-inverting terminal for receiving a reference voltage signal, and an output terminal for outputting an error voltage signal. The BJT 316 has a base terminal connected to the output terminal of the amplifier 314 for receiving the error voltage signal, a collector terminal for receiving an external third supply voltage signal, and an emitter terminal connected to the first node for providing the first supply voltage signal thereto and to ground by way of the capacitor 320 and the resistor 318. In various embodiments of the present invention, the resistor-ladder network 312 may be included in the voltage regulator 313, placed in the IC 300 as an independent circuit, or placed on the PCB as an independent circuit.

In operation, the first logic circuit module 302 receives the first supply voltage signal at the first node from the voltage regulator 313 and the first ground voltage signal at the third node. The first ground voltage signal is at zero voltage level. Hence, a voltage across the first logic circuit module 302 equals the voltage level of the first supply voltage signal. The second logic circuit module 304 receives the second supply voltage signal at the second node and the second ground voltage signal at the fourth node. The second ground voltage signal has a non-zero voltage level, and hence a voltage across the second logic circuit module 304 equals a difference between the voltage levels of the second supply and ground voltage signals. Voltage levels across the first and second logic circuit modules 302 and 304 are required to be within a predetermined voltage range for normal operation of the IC 300. The voltage levels across the first logic circuit module 302 and second logic circuit module 304 should be less than a first predetermined voltage level of the predetermined voltage range and should be more than a second predetermined voltage level of the predetermined voltage range, respectively. The feedback circuit 310 receives the second ground voltage signal and generates the feedback voltage signal. The feedback circuit 310 indicates to the voltage regulator 313 an IR rise of the first voltage level of the ground voltage signal by way of the feedback voltage signal. The resistor-ladder network 312 receives the feedback voltage signal and generates the sense voltage signal based on the feedback voltage signal, resistance values of the resistors 322 and 324, and first ground voltage signal. The function of the resistor-ladder network 312 is well known in the art. The amplifier 314 receives the sense voltage signal and generates the error voltage signal based on a comparison of the sense voltage signal with the reference voltage signal. The BJT 114 receives the error voltage signal and regulates the voltage level of the first supply voltage signal such that the voltage levels across the first and second logic circuit modules 3302 and 304 are within the predetermined voltage range. The resistor 318 and the capacitor 320 provide stability to the voltage regulator 313.

Figure 4:
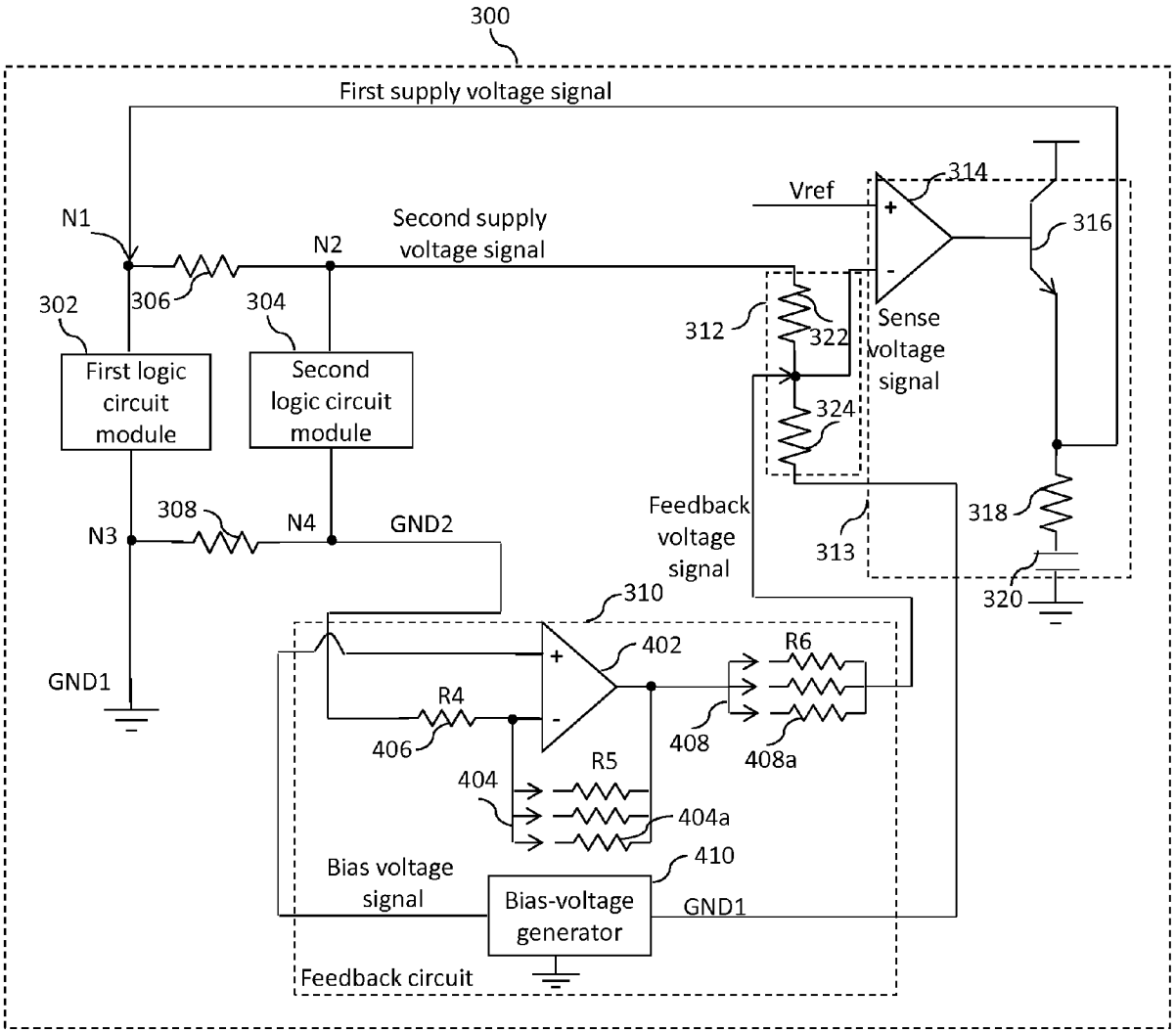
FIG. 4 is a detailed block diagram of an IC that includes a voltage regulator circuit in accordance with an embodiment of the present invention.

Referring now to FIG. 4, a detailed block diagram of an IC 300 for voltage regulation, in accordance with an embodiment of the present invention, is shown. The IC 300 includes a power grid (not shown) having multiple supply and ground voltage lines, first and second logic circuit modules 302 and 304, first and second sets of circuit components 306 and 308, a feedback circuit 310, and a resistor-ladder network 312, and a voltage regulator 313.

The voltage regulator 313 includes a first amplifier 314, a bipolar junction transistor (BJT) 316, a first resistor 318, and a capacitor 320. The resistor-ladder network 310 includes second and third resistors 322 and 324. The feedback circuit 310 includes a second amplifier 402, a first set of resistors 404, a fourth resistor 406, a second set of resistors 408, and a bias-voltage generator 410. The first and second sets of resistors each include multiple resistors connected in parallel.

The bias-voltage generator 410 outputs a bias voltage signal and a first ground voltage signal at first and second terminals thereof, respectively. A first terminal of the fourth resistor 406 is connected to the second node for receiving the second supply voltage signal. The second amplifier 402 has an inverting terminal connected to a second terminal of the fourth resistor 406 for receiving the second supply voltage signal, a non-inverting terminal connected to the first terminal of the bias-voltage generator 410 for receiving the bias voltage signal, and an output terminal for outputting the feedback voltage signal by way of the second set of resistors 408. The second terminal of the bias voltage generator 410 is connected to the second terminal of the third resistor 324. In an embodiment of the present invention, the first set of resistors 404 includes a fifth resistor 404*a*. First and second terminals of the fifth resistor 404*a* are connected to the inverting and output terminals of the second amplifier 402, respectively. In an embodiment of the present invention, the second set of resistors 408 includes a sixth resistor 408*a*. A first terminal of the sixth resistor 408*a* is connected to the output terminal of the second amplifier 402 and a second terminal thereof is connected to the voltage tap. A gain control block (not shown) selects values of the fourth, first set and second set of resistors that determine a gain of the second amplifier 402.

In an embodiment of the present invention, the second amplifier 402 is an inverting amplifier and the fourth and fifth resistors 406 and 404*a* are an input resistor and a feedback resistor of the second amplifier 402, respectively. The functions of the fourth and fifth resistors 406*a* and 404*a* are well known in the art. Unlike an ideal inverting amplifier, the second amplifier 402 receives the bias voltage signal at a non-zero voltage level. The second amplifier 402 compares the second ground voltage signal with the bias voltage signal to generate the feedback voltage signal. A voltage level of the feedback voltage signal indicates an IR rise in the first voltage level of the second ground voltage signal. The feedback voltage signal is provided to the voltage tap of the resistor-ladder network 312. The first ground voltage signal is at a zero voltage level. The resistor-ladder network 312 receives the second supply and first ground voltage signals and generates a sense voltage signal. The first amplifier 314 compares the sense voltage signal with the reference voltage signal and generates an error signal that indicates a difference between the reference voltage and the sense voltage signals. The BJT 316 regulates the first supply voltage signal at the first voltage level and thus, maintains the voltages across the first and second logic circuits within the predetermined voltage range. Thus, the voltage regulator 313 senses the second voltage levels of both the supply voltage signal received at the second node and the ground voltage signal received at the fourth node, thereby accounting for the rise in the first voltage level of the second ground voltage signal at the ground hot point along with the drop in the first voltage level of the second supply voltage signal. In an embodiment of the present invention, the voltage regulator 313 is an external voltage regulator and as the voltage regulator 313 senses the supply and ground voltage signals from the IC, accurate second voltage levels of the supply and ground voltage signals of the second and fourth nodes are available for regulation. As a result, the first voltage levels of the supply and ground voltage signals are correctly regulated. Also, as the voltage regulator 313 senses the supply and ground voltage signals from the IC 300, the IR drop, and rise in the voltage levels of the supply and ground voltage signals, respectively, decreases. Thus, the voltage regulator 313 reduces the first voltage level of the first supply voltage signal that results in a decrease in power dissipation and consequently reduction in packaging costs of the IC 300.

While various embodiments of the present invention have been illustrated and described, it will be clear that the present invention is not limited to these embodiments only. Numerous modifications, changes, variations, substitutions, and equivalents will be apparent to those skilled in the art, without departing from the spirit and scope of the present invention, as described in the claims.

The invention claimed is:

1. A voltage regulation system, comprising:

a power grid having a plurality of supply and ground voltage lines, wherein a first supply voltage line of the plurality of supply voltage lines includes first and second nodes and a first set of circuit components connected therebetween, and a first ground voltage line of the plurality of ground voltage lines includes third and fourth nodes and a second set of circuit components connected therebetween, and wherein the first and third nodes receive first supply and ground voltage signals, respectively, and the second and fourth nodes receive second supply and ground voltage signals, respectively;

a feedback circuit for generating a feedback voltage signal, comprising;

a bias-voltage generator for generating a bias-voltage signal; and a first amplifier having an inverting input terminal connected to the fourth node by way of a first resistor for receiving the second ground voltage signal, a non-inverting input terminal connected to the bias-voltage generator for receiving the bias-voltage signal, and an output terminal connected to the inverting input terminal thereof by way of a second resistor for generating the feedback voltage signal;

a resistor-ladder circuit, connected between the second node and ground, having a voltage tap connected to the output terminal of the first amplifier by way of a third resistor for receiving the feedback voltage signal, wherein the resistor-ladder circuit generates a sense voltage signal; and a voltage regulator that receives an external third supply voltage signal, wherein the voltage regulator is connected to the voltage tap for receiving the sense voltage signal, and the first node for providing the first supply voltage signal thereto, and wherein the voltage regulator regulates the first supply voltage signal at a first voltage level.

2. The voltage regulation system of claim 1, wherein a voltage level of the second supply voltage signal is equal to a difference between a voltage level of the first supply voltage signal and a voltage drop across the first set of circuit components and a voltage level of the second ground voltage signal is equal to a sum of a voltage level of the first ground voltage signal and a voltage rise across the second set of circuit components.

3. The voltage regulation system of claim 2, wherein the feedback voltage signal is a function of voltage levels of the bias-voltage signal and the second ground voltage signal.

4. The voltage regulation system of claim 3, wherein the sense voltage signal is a function of a voltage level of the feedback voltage signal and a voltage signal of the second supply voltage signal.

5. The voltage regulation system of claim 4, wherein the voltage regulator scales a voltage level of the sense voltage signal to the first voltage level by multiplying the sense voltage signal by a predefined scaling factor.

6. The voltage regulation system of claim 5, wherein the voltage regulator further includes:

a second amplifier having an inverting input terminal connected to the voltage tap of the resistor-ladder circuit for receiving the sense voltage signal, a non-inverting input terminal connected to the bias-voltage generator for receiving a reference voltage signal, and an output terminal for outputting an error voltage signal; and a bipolar junction transistor (BJT) having a collector terminal for receiving the external third supply voltage signal, a base terminal connected to the output terminal of the second amplifier for receiving the error voltage signal, and an emitter terminal connected to the first node for providing the first supply voltage signal thereto and to ground by way of a capacitor and a resistor.

7. The voltage regulation system of claim 6, wherein the capacitor stores a charge equivalent to the voltage level of the first supply voltage signal.

* * * * *